US005788093A

United States Patent [19]

Krut

[11] Patent Number: 5,788,093

[45] Date of Patent: Aug. 4, 1998

[54] OBJECT SUPPORT SYSTEM

[76] Inventor: Wayne G. Krut, 1224 Manor Oaks Ct., Dunwoody, Ga. 30338

[21] Appl. No.: 649,221

[22] Filed: May 17, 1996

[51] Int. Cl.[6] ..... A47F 5/00

[52] U.S. Cl. ..... 211/119; 211/106; 211/103; 211/90.02; 211/90.03

[58] Field of Search ..... 211/119, 113, 211/181.1, 106, 103, 88.01, 90.02, 90.03, 193, 187, 94.02

[56] References Cited

U.S. PATENT DOCUMENTS

| | | | |
|---|---|---|---|
| 2,589,564 | 3/1952 | Moore | 211/106 X |
| 3,203,558 | 8/1965 | Ullman | 211/119 X |
| 4,106,736 | 8/1978 | Becker et al. | 211/103 X |
| 4,250,815 | 2/1981 | Swanson | 211/193 X |
| 5,158,186 | 10/1992 | Krut | 211/113 |
| 5,160,052 | 11/1992 | Wudka | 211/90.02 |
| 5,460,279 | 10/1995 | Emery et al. | 211/106 |
| 5,511,675 | 4/1996 | Frederick | 211/94.5 X |
| 5,634,760 | 6/1997 | Anderson et al. | 211/119 X |

FOREIGN PATENT DOCUMENTS

| | | | |
|---|---|---|---|
| 1102977 | 2/1968 | United Kingdom | 211/106 |

*Primary Examiner*—Robert W. Gibson, Jr.
*Attorney, Agent, or Firm*—Bernstein & Associates

[57] ABSTRACT

An object support system for use in a confined space and supportable from a support structure such as a door includes a support frame having vertically disposed side rails and horizontally extending support arms extending from the side rails. Containers, for supporting objects, are adapted to be supported from the support frame by the support arms through pins adapted to compressively engage the side rail and to abut the support arms. Hanging file folders are also suitable for being supported from the support frame.

6 Claims, 7 Drawing Sheets

SIDE VIEW

OBJECT SUPPORT SYSTEM

TECHNICAL FIELD

The present invention relates generally to an object support system and, more particularly, to an object support system supported from a support structure, such as a door, or an office partition, and adapted to support object holding containers such as hanging file folders, baskets, shelves, and trays.

BACKGROUND OF THE INVENTION

Storage space for storing objects around the house or at an office always seems to be in short supply, particularly with the growth of offices in the home. Additional storage capacity may be provided in traditional ways such as by installing new, wall-mounted shelves or filing cabinets. This solution for providing additional storage space is often times expensive and time consuming.

Adding additional storage capacity may be prevented by architectural restrictions inherent in the dwelling or office building or by other limitations. Oftentimes, the space necessary for providing more storage capacity is generally not available. Therefore, other means must be employed to utilize the space available. Known storage systems include free standing systems having a rectangularly configured frame supporting one or more baskets that may be slide mounted. Another system for storing files in hanging file folders is shown in U.S. Pat. No. 5,158,186, issued to Krut, which is incorporated herein by reference. Krut shows a hanging file system that is adapted to be supported in a confined space such as along the surface of a door. The Krut device, although effective in its usefulness for storing files in a space-efficient and accessible manner, does not fully disclose devices or apparatus for storing other objects such as office supplies, computer diskettes, CD ROMS and tape cartridges, or household or other utility items.

What is needed is a storage system that is adapted to be supported in a confined space such as adjacent to a wall, a door, or an office partition or panel, or other vertical structure, and which is adapted to support containers useful for storing objects such as office supplies, computer data storage devices, such as diskettes, CD ROMS, tape cartridges, hanging file folders, household items, tools, hardware and the like.

SUMMARY OF THE INVENTION

The present invention solves the above described problems by providing an object support system which is supported in a confined space by a support structure such as a door, wall or an office partition or panel, or other vertical surfaces and is adapted for supporting objects such as office supplies, computer data storage devices, hanging file folders, household items, tools, hardware and the like.

Generally described, the present invention includes a frame having opposed side frame assemblies each comprising an elongate vertically disposed side rail. Support arms extend horizontally from and are disposed in engagement with each of the side rails such that cooperating sets of support arms lie in the same horizontal plane. In a preferred embodiment, the present invention further includes a container adapted to be supported by the side rails. The container, which may take any of several specific shapes and construction material(s), such as wire, plastic, wood, cardboard, or any other material, is configured to define an object support surface or receptacle for supporting objects placed on the support surface. The container is supported from the side rails by upper and lower horizontal support pins extending outwardly of the container. The container is positioned adjacent the side rails and the upper and lower support pins are engaged with the side rails such that a forwardly facing surface of the upper support pins is in compressive engagement with a rearwardly facing surface of the side rails and a rearwardly facing surface of the lower support pins is in compressive engagement with a forwardly facing surface of the side rails.

In a second embodiment of the present invention the object support system is adapted to support a hanging file folder from support arms of the object support system. The hanging file folders comprise a folded folder jacket and stiffening rods extending from the folder jacket at the opposed ends of the folder jacket. The support arms may be cantilevered or may be supported at both ends by side rails.

In a third embodiment of the present invention a container comprising opposed folded over side supports is adapted to be supported from the support arms of the frame. The support arms may be cantilever support arms or may be supported at both ends by vertically extending side rails.

Therefore, it is an object of the present invention to provide an improved object support system for supporting objects from a support structure.

It is a further object of the present invention to provide an object support system that is adaptable to support a variety of containers from the same support frame, the containers adapted to hold and organize particular items.

It is still another object to provide an object support system for supporting objects in a confined area without requiring the use of floor space, countertop or desk space or drawer space.

Other objects, advantages and features of the present invention will be more readily understood from the following detailed description of specific embodiments thereof when read in conjunction with the accompanying drawings.

DETAILED DESCRIPTION

Figure 1:
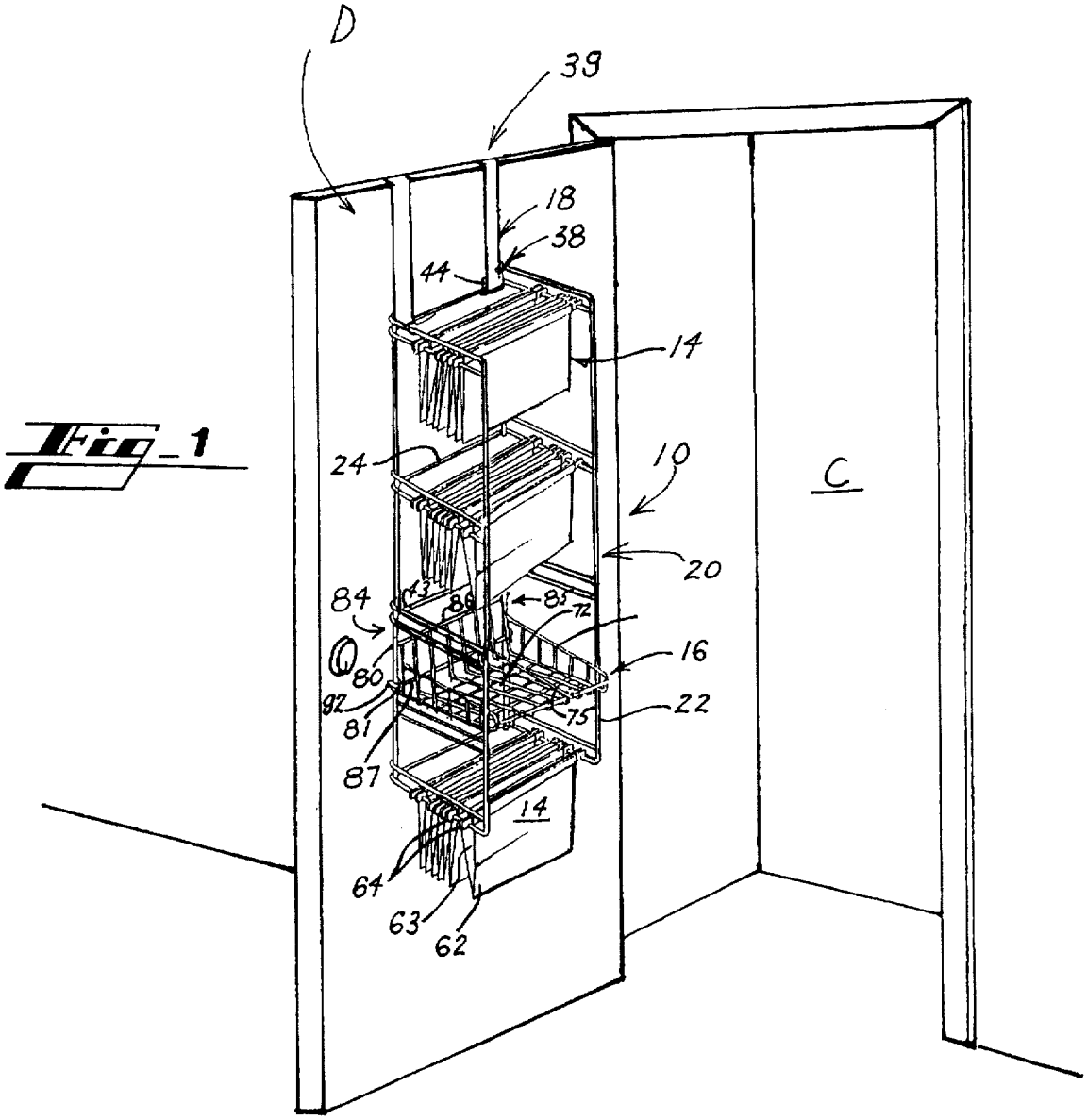
FIG. 1 is a perspective view of the object storage system of the present invention shown adapted to support hanging file folders and a wire container.

Referring now in more detail to the drawings, in which like numerals refer to like parts throughout the several views, FIG. 1 shows an object support system 10 adapted to support hanging files 14 and a wire grid container 16. The object support system 10 is shown supported adjacent the rear panel of a door D of a closet C by one or preferably a pair of hangers 18. The door D provides a support structure for supporting the object support system 10 in a convenient location. It is understood by those skilled in the art that support structures other than a door may be used to support the object support system 10. For example the object support system 10 could be supported by and adjacent to a filing cabinet, a wall, a partition or panel of a modular office system, and other structures.

The object support system 10 includes a support frame 20 having opposed side frame assemblies 22 maintained in spaced apart relation by lateral supports 24. The frame 20 may be fabricated of steel wire, vinyl coated for durability and appearance, or plastic or composite materials.

Figure 4:
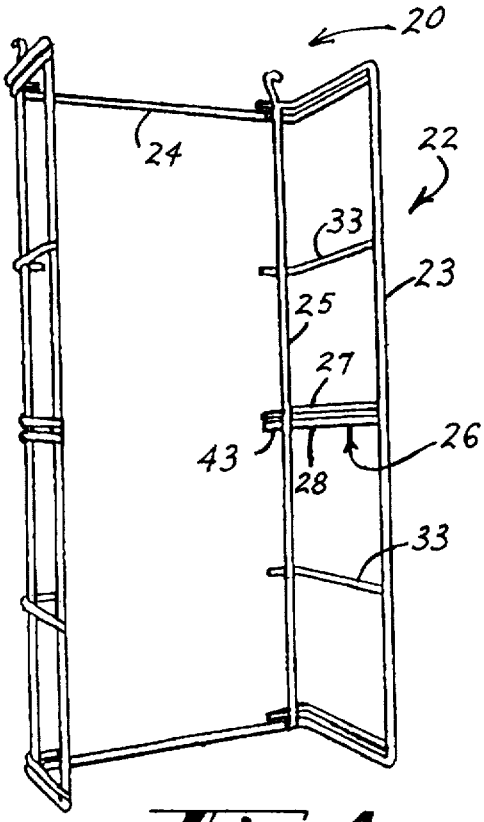
FIG. 4 is a perspective view of a second embodiment of the support frame of the object storage system of the present invention with the support arms supported at both ends by vertically disposed side rails.
Figure 5:
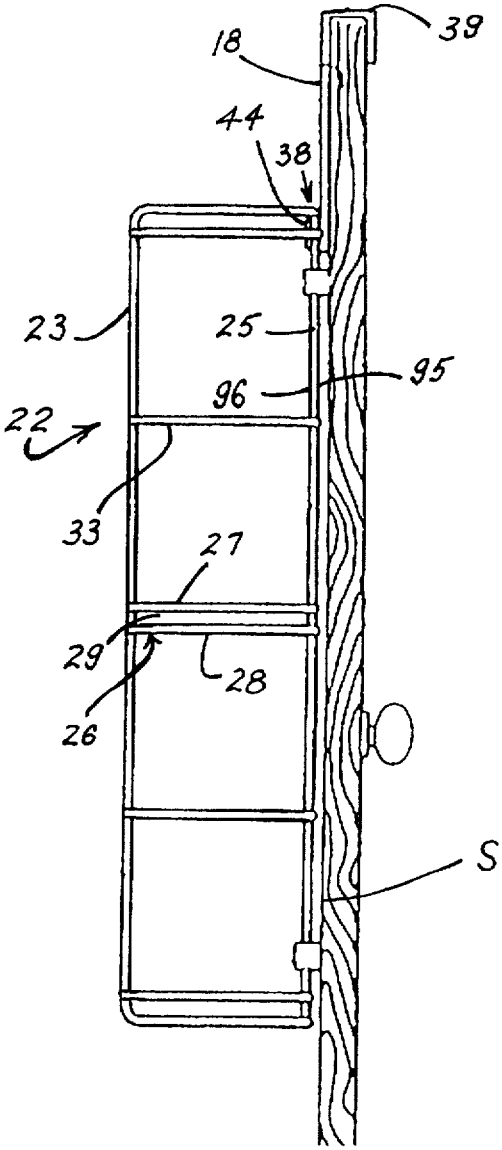
FIG. 5 is a side view of the support frame shown in FIG. 4 mounted to a door.
Figure 6:
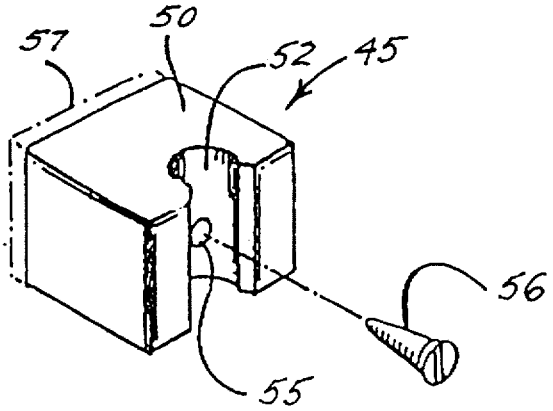
FIG. 6 is a perspective view of a typical bumper block used in a manner shown in FIGS. 5 and 3.
Figure 7:
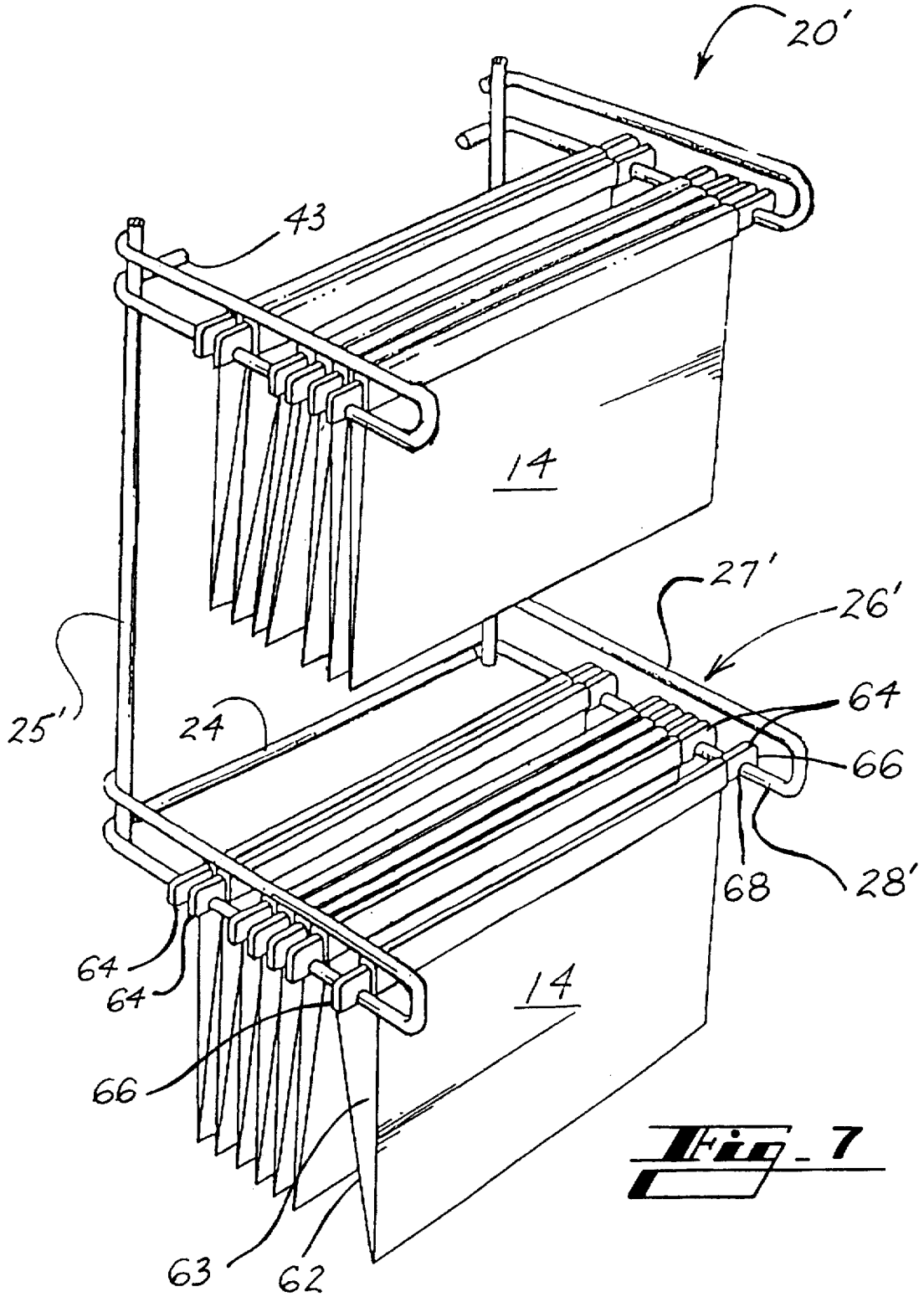
FIG. 7 is a perspective view of a portion of the object storage system of the present invention provided with cantilevered support arms shown supporting hanging file folders.

The frame 20 is shown in greater detail in FIGS. 4 and 5. The side frame assemblies 22 comprise front and rear vertically disposed side rails 23 and 25. Support arms 26 comprising upper and lower parallel rods 27 and 28 extend between and join the side rails 23 and 25. The parallel rods define a gap 29 therebetween. Rods 33 extend between and join the side rails 23 and 25 to further strengthen the side frame assemblies 22, and prevent papers from sliding laterally out of file folders.

Figure 2:
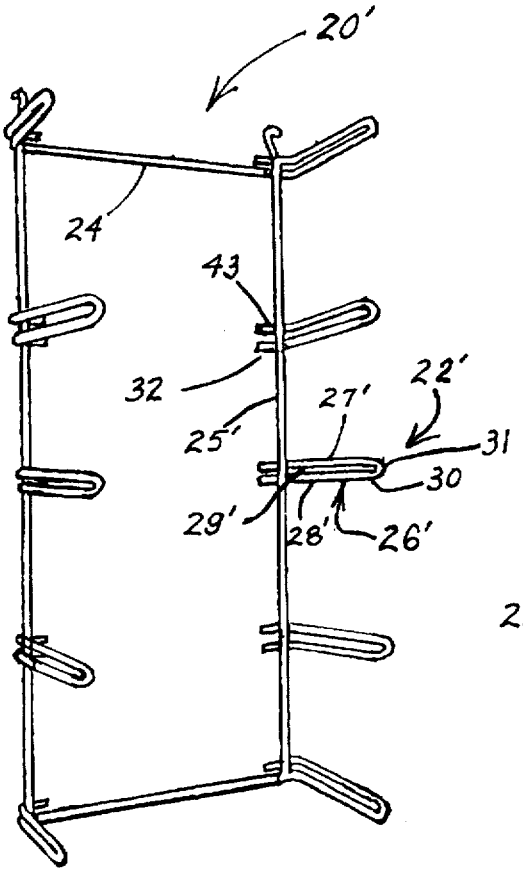
FIG. 2 is a perspective view of a first embodiment of the support frame of the object storage system of the present invention provided with cantilevered container support arms.
Figure 3:
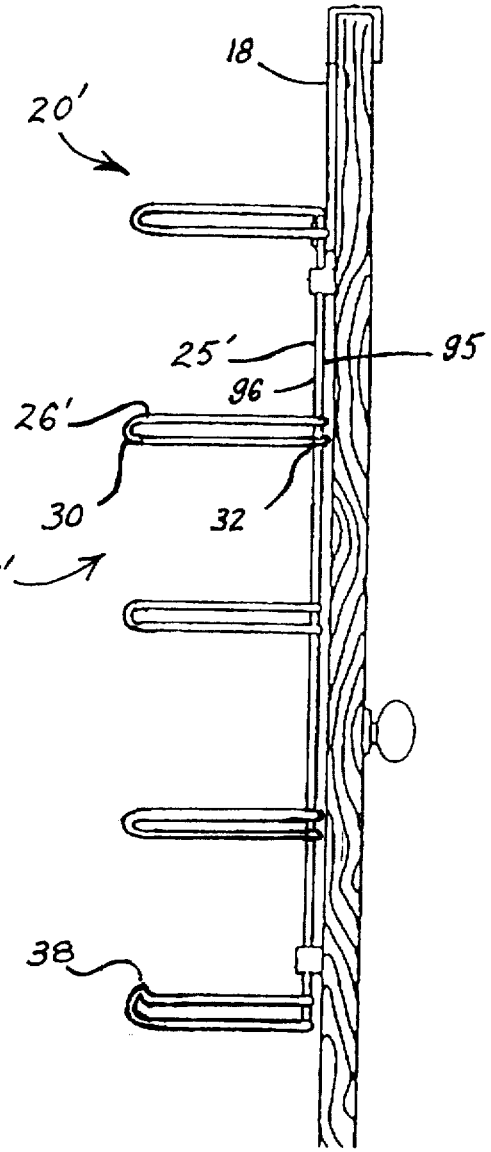
FIG. 3 is a side view of the support frame shown in FIG. 2 mounted to a door.

Looking now at FIGS. 2 and 3, there is shown a second alternative embodiment of the frame, designated 20'. The frame 20' includes side frame assemblies 22' comprising cantilevered support arms 26' extending perpendicularly from opposed vertically disposed rear side rails 25'. Each of the support arms 26' comprises an elongate narrow U-shaped rod 30 having a closed end 31 projecting outwardly from the side rails 25' and an secured end 32 securely engaged with the side rail 25'. The U-shaped rod 30 defines an upper rod portion 27' and a lower rod portion 28' and a gap 29' therebetween. The upper rod portion 27' may be turned upward to form a forward stop 38 for hanging file folders and other devices which may be hung on rod portion 27'.

The lateral supports 24 of either the first or second embodiment of the frame 20 or 20', may be fixed or adjustable. Where the lateral supports 24 are fixed, the overall width of the object support system 10 defined between the side frame assemblies 22 or 22' is fixed, that is, the width is not readily adjustable. It is to be understood, however, that this embodiment can be modified to present an adjustable width system, for use with legal, letter or other size widths. Such a system may involve telescoping or otherwise inter-engaging support elements. Such modifications are considered within the scope of the present inventions and can be achieved by one skilled in the art without undue experimentation.

The width of the object support system 10 may be made adjustable by providing adjustable lateral supports 24 which comprise tubes of a predetermined length determined by the desired over all width of the system desired. The lateral support tubes are adapted to fit in overlapping engagement with studs 43 extending from the support arms 26 or 26'. Thus, for example, if the hanging file folders to be supported by the object support system are "letter" sized (approximately 12 inches wide) the length of the adjustable lateral supports 24 will be appropriate to provide the spacing between the support arms 26 or 26' sufficient to accommodate the width of the letter sized hanging file folders. If it is desired that the object support system be configured to support "legal" sized hanging file folders (approximately 15 inches in width) the adjustable lateral supports 24 will be longer as compared to those necessary only to accommodate the letter sized hanging file folders. Advantageously, a purchaser of the object support system need not purchase particular width object support systems. Rather, the purchaser need only be provided with alternative length adjustable lateral supports 24. This adjustable width feature also allows the object support system 10 to accommodate different width containers supportable by the support arms 26 or 26'. Standard size hanging file folders are commercially available from most office supply stores under the trademark Pendaflex® or other brands.

The frames 20 and 20' are shown supported adjacent to the inside surface of the door D in FIGS. 5 and 3, respectively. The weight of the frame 20 or 20' is supported by the hangers 18. The hangers 18 include a frame engaging end 38 and a door engaging end 39. The frame engaging end 38 includes a generally U-shaped portion 44, which is adapted to engage the opposed pairs of studs 43. The opposed door engaging end 39 is generally L-shaped. The door engaging end 39 is adapted to fit over the upper side surface of a standard door thereby supporting the frame 20 or 20' adjacent the door panel. Hanger 18 may be bent to size to custom-fit on any size or thickness of office partition or panel, or other supporting structure.

The object support system 10 is also supported against unintended movement by a plurality of bumper blocks 45, which are optional. Each bumper block 45 comprises a block shaped body 50 and defines partial circular groove 52 having a diameter slightly greater than the vertical side rails 25 or 25' where the vertical side rails are round in crossection. The circular groove 52 also defines a chord length just slightly less than the diameter of the vertical side rails 25 or 25'. In the preferred embodiment, the bumper block 45 is fabricated of a plastic material such as ABS or PVC. Because of the resiliency of the material of which the bumper block 45 is fabricated, the bumper blocks 45 will snap into place about the vertical side rails 25 or 25' when the vertical side rail 25 or 25' is positioned adjacent the groove 52 and forced into engagement with the vertical side rail 25 or 25'. The vertical side rail 25 or 25' is thus held captively yet removably within the groove 52.

The bumper block 45 further defines a mounting aperture 55 through which a mounting screw 56 is inserted so that the bumper block 45 may be mounted to the support surface of the support structure S. The bumper block 45 is mounted to the support surface of the support structure S such that the vertical side rail 25 or 25' of the object support system 10 will be received into the groove 52 when the frame 20 or 20' is positioned in a desired position. A piece of double sided tape 57 may also be used to secure bumper block 45 to the support surface of the support structure S.

When the vertical side rails 25 or 25' are forced into engagement with the grooves 52 of the bumper blocks 45 the object support system 10 is prevented from swinging or other undesirable movement when the support structure S is moved, such as when a door to which the object support system 10 is attached is swung open or closed. It may be necessary to mount several cooperating bumper blocks 45 to the support surface to fully support and maintain the position of the object support system 10 adjacent the support structure S. Advantageously the bumper blocks 45 prevent the support frame 20 from scratching or otherwise damaging the door D.

Figure 8:
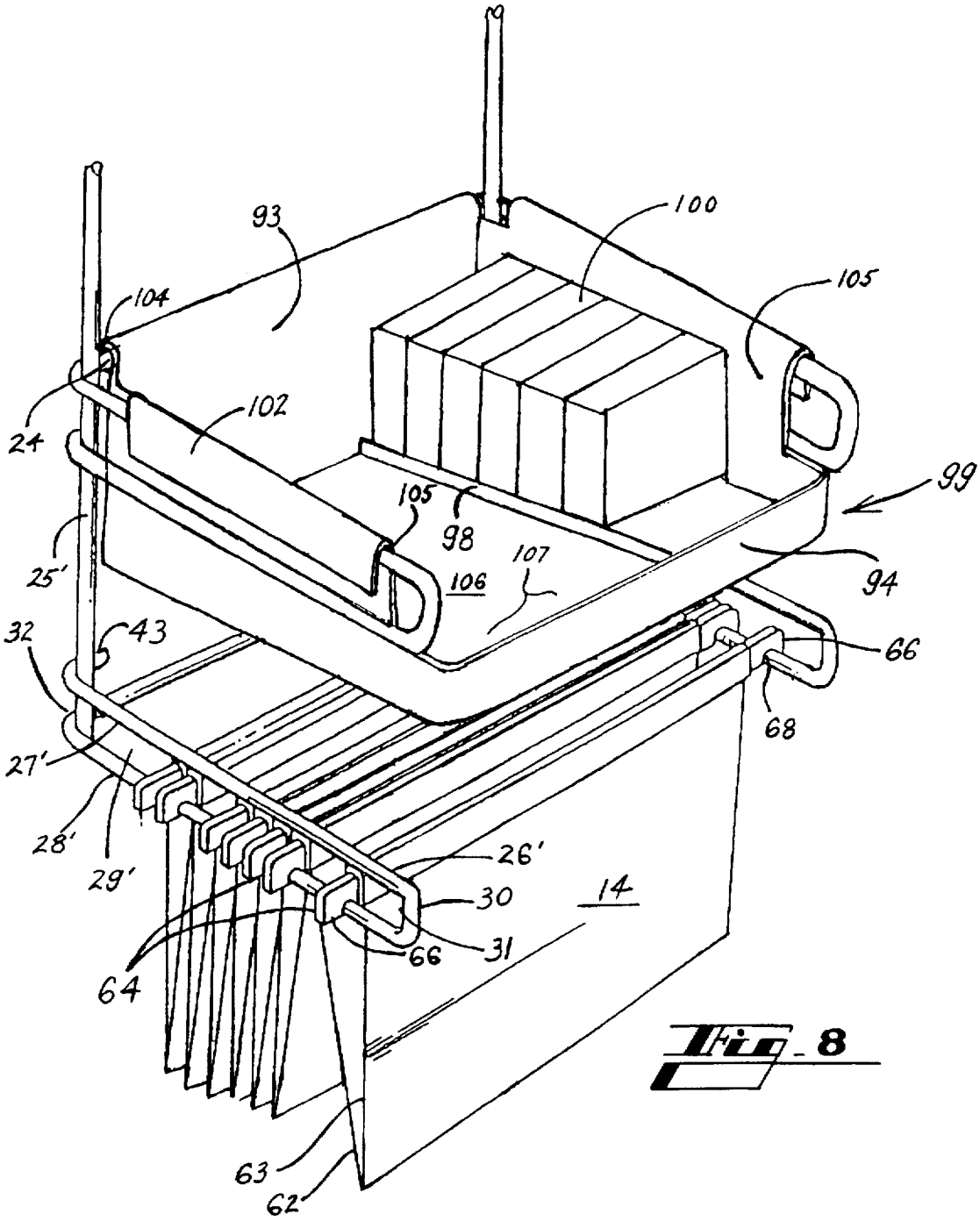
FIG. 8 is a perspective view of a portion of the object storage system having cantilevered container supports arms shown supporting a container tray and hanging file folders.

The object support system 10 is adapted to support several different types of object containers from the frame 20. As shown in FIG. 1 the object support system 10 is configured to support hanging file folders 14 and a steel wire basket 16. In FIG. 8 the object support system 10 is shown supporting hanging file folders 14 and a molded container 99.

Containers supported by the object support system frame 20 or 20' are adapted to be supported by the vertical side rails 25 or 25'. Containers receive additional support against moving down the side rails 25 or 25' by causing a portion of the container to abut a fixed structure mounted to the side rails, such as the support arms 26 or 26'.

The hanging file folders 14 are supportable by the support arms 26 of the frame 20 or the cantilever support arms 26' of the frame 20'. Each hanging file folder 14 comprises a jacket 62, over folded to define a file pocket 63. A cooperating pair of stiffening rods 64 are secured to the opposed ends of the file jacket 62. Opposed ends 66 of the stiffening rods 64 extend outwardly of the file jacket and define a hanger hook comprising a downwardly opening notch 68 which is adapted to engage a supporting rod such as the lower support rod 28 or 28' of the support arm 26 or 26' for example. To support a hanging file folder 14 from the support arm 26 or 26' the opposed ends 66 of the stiffening rods 64 is disposed within the gap 29 or 29'. The notches 68 are then engaged with the lower rod 28 or 28'. The hanging file folders 14 are prevented from falling from the object support system by the closed end 30 of the cantilevered arm 26' or the outer vertical side rail 23 of the object support system 10 shown in FIGS. 5 and 1.

Figure 9:
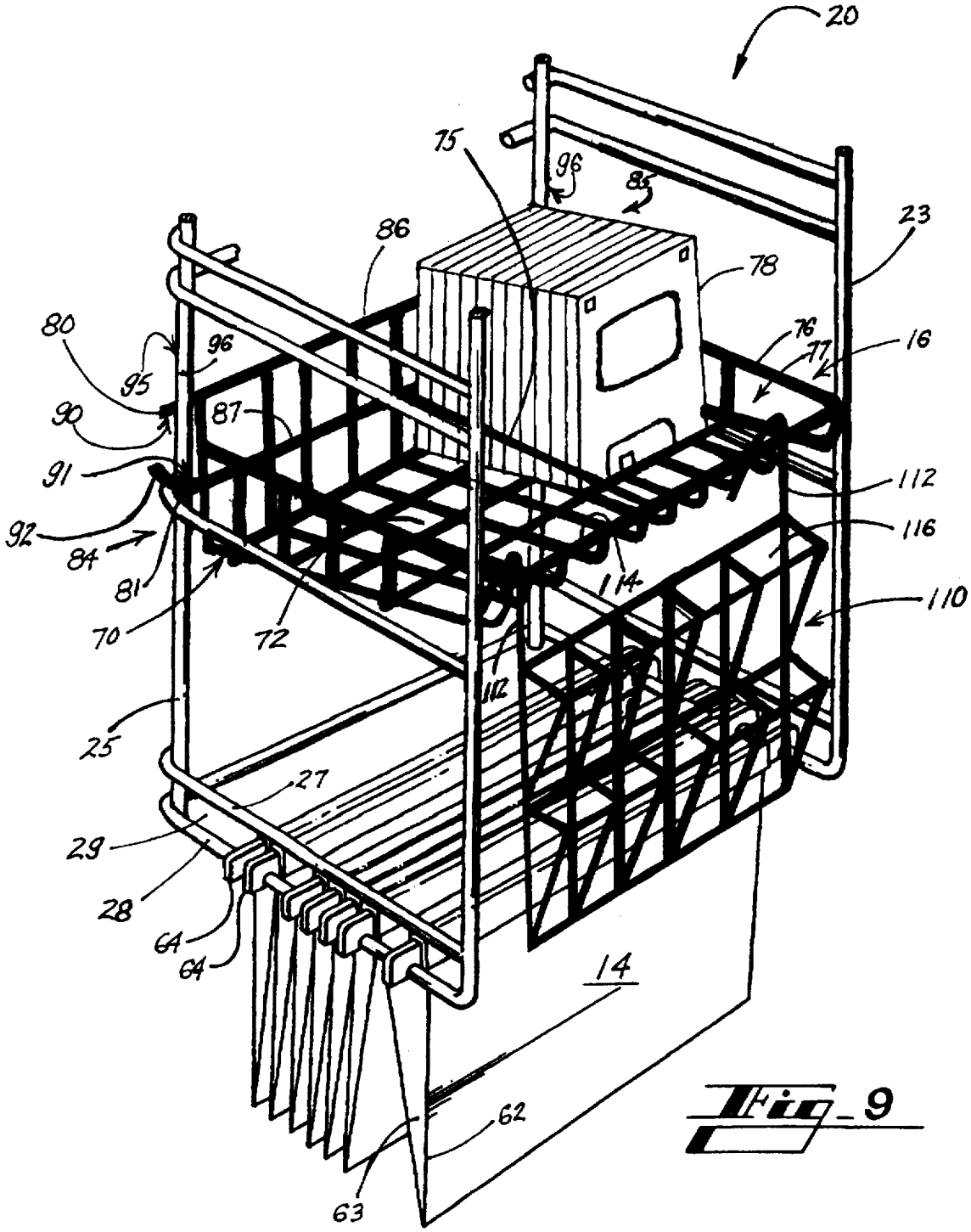
FIG. 9 is a perspective view of a portion of the object support system shown in FIG. 1 with a wire frame auxiliary support container supported by the wire container.

Object containers, such as the wire basket 16 shown in FIGS. 1 and 9, are disposed in supported engagement with the frame 20 or 20' by cooperatively engaging structural projections of the containers 16 with the vertical side rails 25 or 25'. Containers adapted for use with the object support system 10, such as baskets 16, comprise a welded wire frame 70 configured to define an object support surface 72. The welded wire frame 70 of the basket 16 may be configured to define a particularly sized, shaped or configured object support surface 72. For example, the container 16 includes a separator bar 75 which is spaced apart from a sidewall 76 of the basket 16. The location of the separator bar with respect to the sidewall 76 is specified so that a portion 77 of the support surface 72 is sized to receive a particular sized item therein. Thus, for example, the position of the separator bar 75 may be such that the portion 77 provides a space properly sized to receive and to support in ordered arrangement computer diskettes 78, as is shown in FIG. 9.

The container 16 further includes upper and lower support pins 80 and 81, respectively, extending from opposed sides 84 and 85 of the container 16. The upper support pins 80 are the end portions of a structural member 86 of the wire frame 70. The lower support pins are the end portion of a structural member 87 of the wire frame 70. It should be understood that the support pins 80 and 81 could be separate parts attached to the wire frame 70 and not portions of structural members of the wire frame 70.

Support pin 80 defines an engaging surface 90 along the forwardly facing portion of the pin 80. Support pin 81 defines an engaging surface 91 along the rearwardly facing portion of the pin 81. Support pin 81 also includes a hooked portion, the significance of which is explained below.

The container 16 is supported in engagement with the frame 20 or 20' by engaging the upper and lower support pins 80 and 81 such that the engaging surface 90 is disposed in compressive engagement with a rearwardly facing surface 95 of the vertical side rails 25 or 25' or alternately, vertical side rail 23, and the engaging surface 91 is disposed in compressive engagement with a forwardly facing surface 96 of the vertical side rail 25 or 25' or alternately, vertical side rail 23. For additional or vertical stability, some portion of the container 16 should contact a fixed projection or structure, such as the upper rod 27 or 27' of the support arm 26 or 26', or rod 33.

The support of the container 16 through the support pins 80 and 81 is effected by the friction between the engaging surfaces 90 and 91 and the vertical side rail 25 or 25'. It should be noted that there is no contribution of support from the forward vertical side rail 23 of the frame 22 shown in FIGS. 1, 4–5 and 9. The frictional forces are the result of the weight of container 16 acting through the center of gravity of the container 16 which acts vertically through the support surface 72. This creates a rotational force about an imaginary axis passing through the wire frame between the pins 80 and 81 and coincident with the vertical side rails 25 or 25'. The counteractive forces to prevent the container 16 from moving is provided by the engagement of the pins 80 and 81 with the vertical side rail 25 or 25'. Provided that the frictional force is sufficient the container 16 will remain in position without moving down the vertical side rails 25 or 25'. To help ensure that the container 16 remains in a particular location on the vertical side rails 25 or 25' the container may be abutted such that the upper or lower pin 80 and 81 engages a structure securely attached to the vertical side rails 25 or 25'. Thus, as shown in FIG. 9, the container 16 is positioned such that the lower pins 81 engage the upper rod 27 of the support arm 26. Alternatively, the upper pin 80 could be juxtaposed with the upper and lower rods 27 and 28 and within the gap 29 of the support arm 26 directly above the container 16 shown in FIG. 9. In this position and support configuration the lower pin 81 would not be in contact with the support arm 26 as described above but would still be prevented from any unintended movement downwardly along the vertical side rails 25 or 25'.

Figure 10:
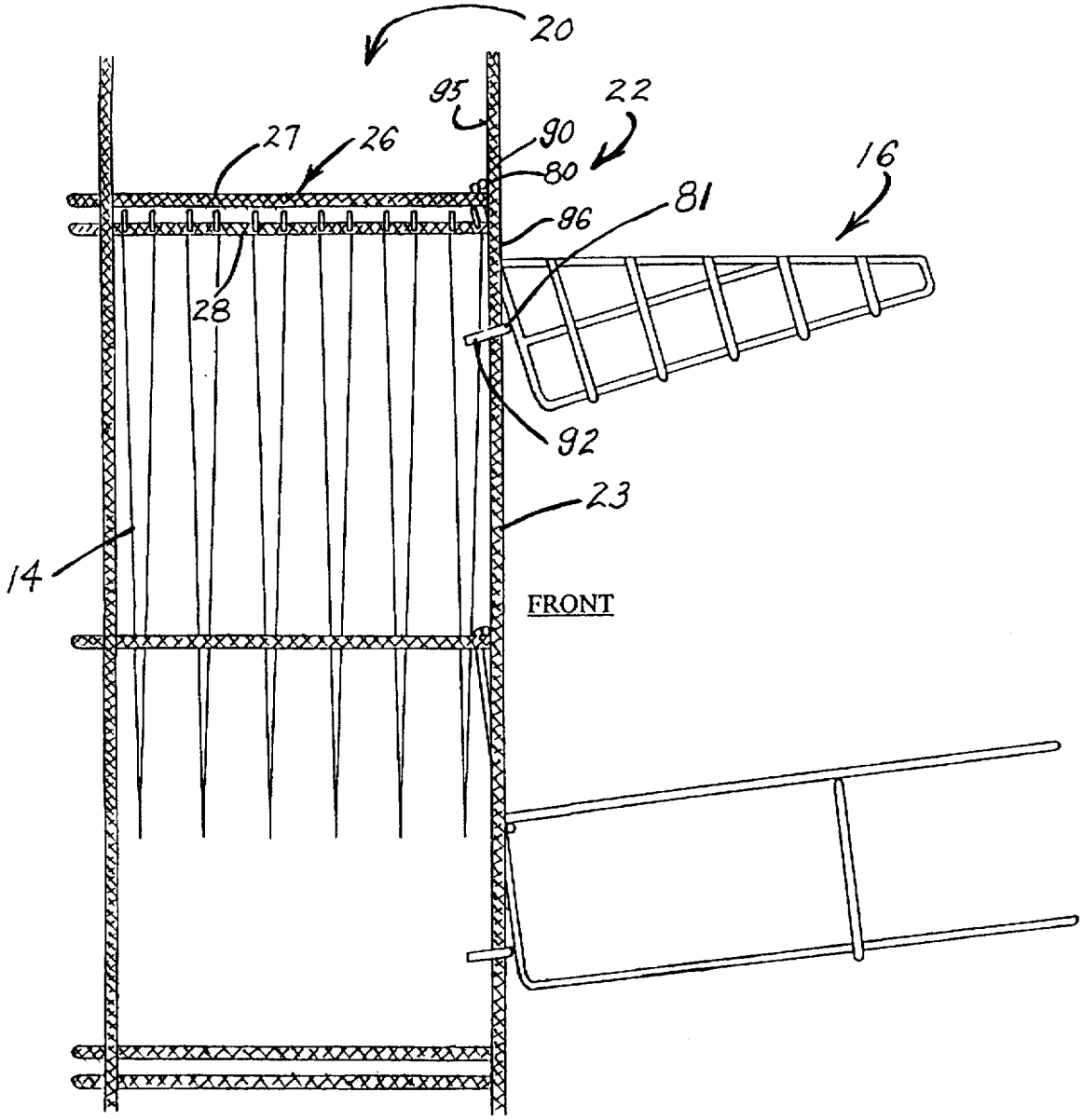
FIG. 10 is a side view of the object support system showing containers supported by the front pair of side rails.

The container 16 is sized and configured to fit fully within the space defined between the side frames 22 or 22'. To properly engage the pins 80 and 81 with the vertical side rails 25 or 25', the container 16 is introduced between the frame members 22 or 22' and then tipped and tilted so as to locate the upper support pins 80 behind the vertical side rails 25 or 25', or alternately forward vertical side rails 23 as shown in FIG. 10. Then, the container 16 is leveled and then dropped into position whereby the support pins 81 then engage the vertical side rail 25 or 25'. The hooked portions 92 center the container 16 within the space between the frame members 22 or 22' and prevent unintended side-to-side movement of the container 16 which enhances the stability of the container 16 supported by the frame 20 or 20' and prevents the container 16 from falling from engagement with the frame 20 or 20'.

Looking now at FIG. 8 there are shown a plurality of hanging file folders and a container 99 supported by the cantilevered support arms 26' of the object support system 10. It should be understood by those skilled in the art that container 99 is similarly adapted to be supported by support arms 26 of the frame 20, or 20'.

The container 99 is fabricated of molded plastic however a container having similar physical details could be fabricated of other materials including metal, wood, and paper. The container 99 includes opposed sidewalls 105 and a rear wall 93 upwardly extending from a bottom panel 106 which defines a support surface 107. The container 99 also includes a front lip 94 extending from the bottom panel 106 and engaged with a partial portion of the sidewalls 105. An upwardly projecting organizer rib 98 extends from the front lip 94 to the rear wall 93 along the bottom panel 106. The organizer rib 98 may be spaced apart from the sidewalls 105 a prescribed distance determined by the width, or other significant dimension, of an object intended to be stored and organized in the container 99. For example, a plurality of objects 100 depicting cassette tape enclosure cases are shown supported and arranged in the container 99. Alternatively, the rib spacing may be arbitrarily determined and be intended to provide an organizing enhancement to the container 99 for a variety of objects.

The sidewalls 105 include a U-shaped folded over support edge 102 which is adapted to supportingly engage the upper bar 27' of the support arm 26'. The rear wall 93 may also include a folded over support edge 104 which is adapted to engage a stud 43 or over to top hanging file folders, or any other suitable supporting surface. The support edge 104 engaged with the lateral support 24 prevents the container 99 from unexpectedly or unintentionally sliding from engagement with the support arms 26'. Thus, closing or opening the partition or door, upon which the object support system is mounted, or any jarring from usage, will not cause the container 99 to fall from the support arms 26'.

In FIG. 9 there is shown an auxiliary container 110 supported form container 16 by cooperating hooks 112 engaged along a front edge structural wire 114 of the container 16 or onto hanging file folders or other suitable support structure. Side hooks also hook to 27 or 28 or 27' or 28'. The auxiliary container 110 defines a plurality of pockets 116 sized to received objects therein. All containers may be placed inside or outside 20 or 20'.

An advantage of the preset invention is the flexibility in inserting and removing different basket or container components from the support system frame 20, depending on the user's needs. The user can select only those components needed and position them at any of several height locations along the frame and inside or on front outside of the frame. The angled construction of the containers 16 and 99 permit stable storage of the disks or cassettes while providing easy access and viewing of labels identifying the disk or cassette.

While the present invention in its various aspects has been described in detail with regard to preferred embodiments thereof, it should be understood that variations, modifications and enhancements can be made to the disclosed apparatus and procedures without departing from the spirit and scope of the present invention as defined in the appended claims.

What is claimed is:

1. An object support system for supporting objects from a support structure defining a support surface, said object support system comprising:

opposed side frame assemblies, each of said side frame assemblies comprising opposed elongate vertical side rails, said vertical side rails disposed in spaced apart relation and adapted to be supported by the support structure;

at least one container support arm engaged with each of said opposed elongate vertical side rails and projecting outwardly from the support surface, wherein said container support arm engaged with one of said opposed elongate vertical side rails lies in the same horizontal plane as said at least one container support arm engaged with another of said opposed elongate vertical side rails; and a container defining an object support surface upon which objects may be placed and supported thereby, said container including:

opposed upper support pins extending horizontally outwardly from opposed sides of said container, said upper support pins defining a forwardly facing engaging surface; and opposed lower support pins extending horizontally outwardly from opposed sides of said container, said lower support pins being spaced apart from said upper support pins and defining a rearwardly facing engaging surface, wherein said upper support pins and said lower support pins are adapted to engage said vertical side rails when said container is disposed in supported engagement with said support frame such that said forwardly facing engaging surface of each of said opposed upper support pins is disposed in compressive engagement with said vertical side rails and said rearwardly facing engaging surface of each of said lower support pins compressively engages said vertical side rails and said container engages portions of said container support arm thereby fixedly yet adjustably supporting said container from said support frame.

2. The apparatus of claim 1, further including an elongate lateral support extending between and in engagement with said side support assemblies to maintain said vertical side rails a predetermined spaced apart distance.

3. The apparatus of claim 2, wherein said side rail of each side frame assembly comprises at least one tube support stub projecting substantially perpendicularly from said side rail, and further including an elongate lateral support tube engaged with said tube support stub to provide lateral support to said side frame assemblies.

4. The apparatus of claim 3, wherein each of said support arms comprises spaced apart upper and lower parallel disposed rods extending from said side rail substantially perpendicularly therefrom, said rods being adapted to support said container when said container is disposed in engagement with said support frame.

5. An object support system for supporting objects from a support structure defining a support surface, said object support system comprising:

opposed side frame assemblies, each of said side frame assemblies comprising opposed elongate vertical side rails, said vertical side rails disposed in spaced apart relation and adapted to be supported by said support structure;

at least one container support arm engaged with each of said opposed elongate vertical side rails and projecting outwardly from the support surface, wherein said container support arm engaged with one of said opposed elongate vertical side rails lies in the same horizontal plane as said at least one container support arm engaged with another of said opposed elongate vertical side rails; and a container defining an object support surface upon which objects may be placed and supported thereby, said container including:

a bottom panel defining said object support surface;

opposed sidewalls extending from said bottom panel and substantially perpendicularly thereto;

a rear wall extending from said bottom panel and substantially perpendicularly to said bottom panels and said sidewalls;

said opposed sidewalls include a U-shaped folded over support edge, said support edge adapted to be support by said container support arm to support said container in engagement with said support frame;

upper support pins extending horizontally outwardly from opposed sides of said container, said upper support pins defining a forwardly facing engaging surface; and opposed lower support pins extending horizontally outwardly from opposed sides of said container, said lower support pins being spaced apart from said upper support pins and defining a rearwardly facing engaging surface, wherein said upper support pins and said lower support pins are adapted to engage said vertical side rails when said container is disposed in supported engagement with said support frame such that said forwardly facing engaging surface of each of said opposed upper support pins is disposed in compressive engagement with said vertical side rails and said rearwardly facing engaging surface of each of said lower support pins compressively engages said vertical side rails and said container engages portions of said container support arm thereby fixedly yet adjustably supporting said container from said support frame.

6. A container for use with an object support system, the object support system comprising a support surface, said object support system comprising opposed side frame assemblies, each of the side frame assemblies comprising opposed elongate vertical side rails, the vertical side rails disposed in spaced apart relation and adapted to be supported by a support structure, and a container support arm engaged with each of the opposed elongate vertical side rails and projecting outwardly from the support surface, wherein the container support arm engaged with one of the opposed elongate vertical side rails lies in the same horizontal plane as the container support arm engaged with another of the opposed elongate vertical side rails, said container comprising:

a container body comprising a plurality of sidewalls extending from a bottom panel, said bottom panel defining an object support surface upon which objects may be placed and supported thereby;

opposed upper support pins extending horizontally outwardly from opposed sidewalls of said container, said upper support pins defining a forwardly facing engaging surface; and, opposed lower support pins extending horizontally outwardly from opposed sides of said container, said lower support pins being spaced apart from said upper support pins and defining a rearwardly facing engaging surface, wherein said upper support pins and said lower support pins are adapted to engage the vertical side rails of the object support system when said container is disposed in supported engagement with the support frame such that said forwardly facing engaging surface of each of said opposed upper support pins is disposed in compressive engagement with said vertical side rails and said rearwardly facing engaging surface of each of said lower support pins compressively engages the vertical side rails and said container engages portions of the container support arm thereby fixedly yet adjustably supporting said container from the support frame.

* * * * *